United States Patent [19]

Porter

[11] 4,290,278

[45] Sep. 22, 1981

[54] MACHINE FOR PRODUCING STITCH BONDED FABRIC

[75] Inventor: Kenneth Porter, Harrogate, England

[73] Assignee: Imperial Chemical Industries Limited, London, England

[21] Appl. No.: 96,475

[22] Filed: Nov. 21, 1979

[30] Foreign Application Priority Data

Sep. 25, 1979 [GB] United Kingdom ..... 7933141

[51] Int. Cl.[3] ..... D04B 23/06; D04B 23/08; D04B 23/10; D04B 23/12

[52] U.S. Cl. ..... 66/84 A; 28/100; 66/125 B; 66/85 A

[58] Field of Search ..... 28/100; 66/85 A, 84 A, 66/85, 84, 125

[56] References Cited

U.S. PATENT DOCUMENTS 3,134,248 5/1964 Kubecka et al. ..... 66/125

3,551,265 12/1970 Jackson ..... 28/100

3,791,900 2/1974 Goerden et al. ..... 28/100

FOREIGN PATENT DOCUMENTS 159324 8/1953 Australia ..... 28/100

*Primary Examiner*—Ronald Feldbaum

*Attorney, Agent, or Firm*—Cushman, Darby & Cushman

[57] ABSTRACT

A machine for producing stitch bonded fabrics comprising means for supplying a layer of warp threads, means for continuously supplying a weft thread, means for supplying a plurality of stitching threads and means for stitching the warp layer and weft thread together with said stitching threads, the improvement being that the means for supplying and laying the weft thread consists of a pair of closely spaced plates, means for forwarding an individual thread towards the plates and means for imparting an oscillatory motion to the forwarded thread before it passes between the plates.

8 Claims, 3 Drawing Figures

MACHINE FOR PRODUCING STITCH BONDED FABRIC

This invention relates to a machine for the production of a textile material by a method which involves laying two layers of threads, warp threads and weft threads, one on the other and stitching the layers together by stitching threads to form a stitch bonded fabric.

In the established method, the warp threads and stitching threads are taken from beams located at the front of the machine, the ends being drawn continuously off the beams and passed to the stitching area. The fabric is formed at this point by stitching the layers of warp threads and weft threads together by, typically, a tricot or chain stitch.

The weft threads are drawn off magazine creels located at both sides of the machine by carriers which move from one side of the machine to the other so that the weft threads are laid in bands across the warp threads. However because of the relative movement between the moving warp threads and the weft threads, the weft threads are laid on the warp threads at a cross-laying angle of between 4° and 6° . Because of this, stitch bonded fabrics produced hitherto have suffered from two main disadvantages: (i) the visual appearance of the fabric is impaired by the barre effect, (ii) the weft strength of the fabric is less than it otherwise might be. Furthermore the method used to lay the weft threads imposes a limitation on the machine speed.

The machine now to be described does not suffer from the above disadvantages.

According to the present invention we provide a machine for producing stitch bonded fabrics comprising means for supplying a layer of warp threads, means for continuously supplying a weft thread, means for supplying a plurality of stitching threads and means for stitching the warp layer and weft thread together with said stitching threads in which the means for supplying and laying the weft thread consists of a pair of closely spaced plates, means for forwarding an individual thread towards the plates and means for imparting an oscillatory motion to the forwarded thread before it passes between the plates.

We also provide a method of producing a stitch bonded fabric comprising forming a layer of warp threads, continuously providing a weft thread, stitching the warp layer and weft thread together by a stitching means with a stitching thread in which the weft thread is introduced to the stitching means by passing an individual thread between two closely spaced plates and imparting an oscillatory motion to the thread before it is passed between the plates.

In this specification the term "layer of warp threads" is used to mean either a plurality of individual warp threads or a fibrous web or a combination thereof.

The above described means for supplying and laying the weft thread, being the characteristic feature of the invention, will now be described in more detail. A compressed gas jet is a convenient means for forwarding the weft thread into the influence of the oscillatory means. Also oscillatory motion may be imparted to thread by a compressed gas jet. Thus compressed gas jets may be located on opposite sides of the forwarding jet outlet and operated alternately so as to direct the thread first in one direction and then in the opposite direction. Alternatively a single intermittently operated gas jet may be used to impart the oscillatory motion.

A single or two part rotary valve may be conveniently used to provide the alternate or intermittent operation of the two jets or the single jet and the speed of rotation of this valve provides a simple control over the amplitude of oscillation described by the strand; the rotation speed being suitably synchronised with the operation of the stitching means for example the rotation speed may be such that one pick is laid per stitch or alternatively any integral number of picks may be laid per stitch or any integral number of stitches per pick may be made. Thus the length of the picks of the weft thread laid on the stitching means may be set by adjustment of the feed speed of the weft thread to be within the range 0.5 meter to 5 meters particularly because the use of closely spaced plates between the oscillating jets and the stitching means allows changes to have their full effect on strand movement. Oscillating jets may have a single orifice or number of orifices in line or preferably a narrow slot for exit of the compressed gas. It is preferred to mount the deflecting jets so that both the angle between the jets, if two are used, and the angle of the or each jet in relation to the moving thread may be adjusted as a further means for controlling strand oscillation.

While deflecting gas jets are preferred, other means may be used to impart oscillation to the thread provided they can induce a sufficiently large amplitude of oscillation to the thread immediately before it is laid down on the warp layer. Such alternative devices may be rotating or oscillating opposed pairs of coanda surfaces which are alternately brought into contact with the moving thread.

Forwarding jets are well known in the art consisting of entry and exit passages for the thread and means to introduce the compressed gas. The exit passage may be convergent or divergent but it is preferred to use a parallel passage to maintain the integrity of the issuing thread passing to the oscillatory means.

The planar plates may be arranged at any suitable angle to the direction of movement of the layer of warp threads and may be uniformly spaced apart throughout their height. Alternatively they may be so arranged that they are inclined to each other so that the space between them converges from the upper ends of the plates to the lower ends of the plates. This convergence of the space as the weft thread approaches the layer of warp threads assists the sideways exhaust of gas (air) and reduces the possible disturbance of the weft threads as they are laid on the warp threads. Furthermore one of the plates may terminate closer to the stitching means than the other plate. Additionally the portion of this plate adjacent to the stitching means may be cranked.

By the term "closely spaced" we mean that the plates are, or less than, 25 mm apart.

When the plates are uniformly spaced apart we prefer that they are between 0.5 mm and 25 mm apart, more preferably 1 mm to 10 mm apart, and most preferably 2 mm to 5 mm apart. When the plates are inclined to each other we prefer that, at their upper end, the plates are between 10 mm and 25 mm apart and at their lower end the plates are an appropriate distance apart selected in the range 2 mm to 5 mm.

We have found that the closely spaced plates which are provided between the oscillatory means and the stitching means causes the thread to assume a planar wave form oscillation, the amplitude of which may increase in successive half waves from the place of oscillation up to a value dependent upon the forces involved and will maintain this planar motion until the thread reaches the stitching means whereon it is laid in a linear configuration. It is preferred that the height of the plates above the stitching means is about the same as the distance required to establish the first crest in the waveform oscillation or the maximum amplitude of an oscillation of this kind is established. The plates should extend as close to the place of oscillation and as close to the stitching means as is practicable so that maximum control of the moving thread is maintained. To further aid linearity of the weft thread and to ensure uniform contact with the stitching means we have found it beneficial to allow a plurality of air jets to impinge on the thread in a direction approximately parallel to one or other of the plates. If necessary these air jets may be pulsed in synchronisation with the stitching means.

The device described makes it possible to lay the weft threads in picks with an exactitude and precision which has not been achieved with the previously used creel/-carrier system. Furthermore the weft threads can be laid with a cross laying angle of substantially 0°.

Use of this device is particularly beneficial in the laying of the weft threads in stitch bonded fabrics at high speeds and in fabric widths in excess of 0.5 m. In order to achieve very high speeds it may be necessary to lay a plurality of discrete threads successively and to this end an appropriate number of pairs of parallel plates and associated supplying means will be required.

In addition the laying of each weft course may be conducted with a very high precision to produce a fabric of substantially uniform thickness.

When the weft threads to be laid are synthetic polymeric filaments then, being non conductors and hydrophobic, they tend to accumulate static charges when in frictional contact with the surfaces of the device and as such charges may disturb the even oscillation or laying of the threads it is advisable to reduce or eliminate the accumulation of such charges by the provision of static discharging means at or near the point of oscillation or by surface treatment of the filaments with an appropriate chemical agent.

It is preferred, when using a gas forwarding jet, that a small amount of the issuing gas is allowed to pass in a gentle current between the plates to assist the passage of an oscillating strand.

The accompanying drawings illustrate the invention and one manner in which it may be performed using compressed gas for forwarding and oscillating the weft threads.

Figure 1:
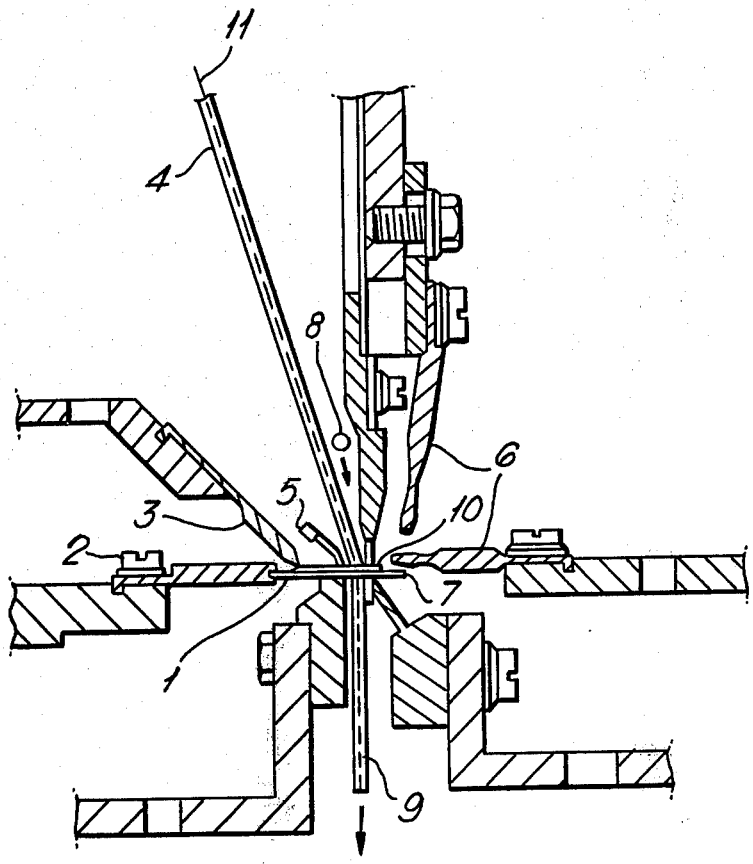
FIG. 1 is a diagrammatic drawing of the general arrangement of a modified Malimo machine in accordance with the invention.

The machine shown in FIG. 1, being a conventional and well known Malimo machine with the exception of components designated 4 and 8, will not be described in detail other than to identify its components:

| | |
|---|---|
| 1 - Needle | 6 - Lapping guide unit |
| 2 - Needle bar | 9 - Stitch bonded fabric |
| 3 - Closing wire | 7 - Layer of Warp threads |
| 5 - Knock over table | 11 - Weft thread |
| 10 - stiching threads | |

In operation of the machine a layer of warp threads 7, a weft thread 11 and stitching threads 10 are passed into the stitching area and a fabric 9 is then formed by stitching the warp and weft together by, typically, a tricot or chain stitch.

In the conventional machine weft threads are drawn off magazine creels (not shown) located at both sides of the machine by carriers (not shown) which move from one side of the machine to the other so that the weft threads are laid across the warp threads.

Figure 2:
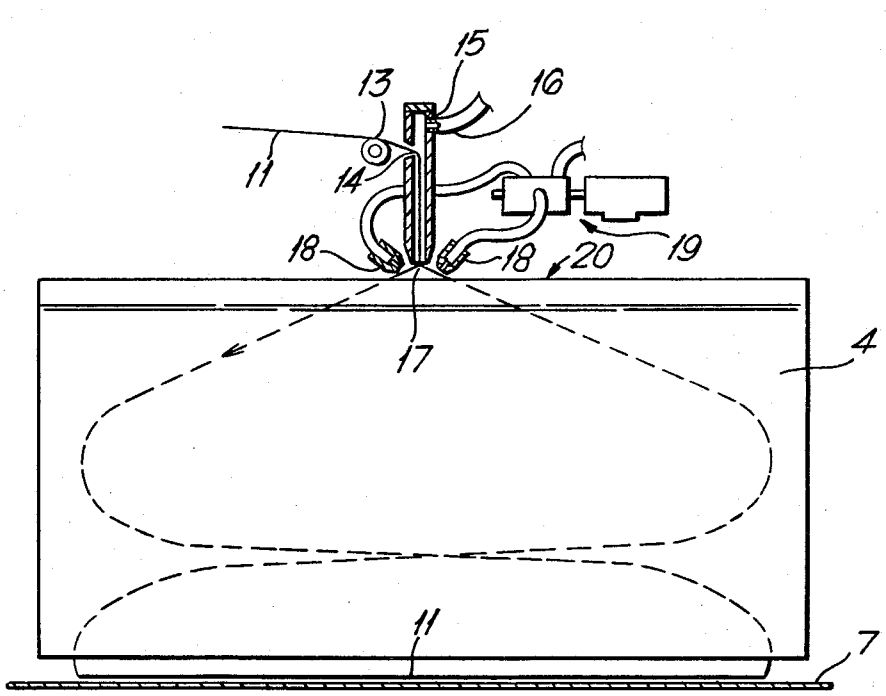
FIG. 2 is a front elevation of the apparatus used to continuously supply a weft thread to the machine shown in FIG. 1.
Figure 3:
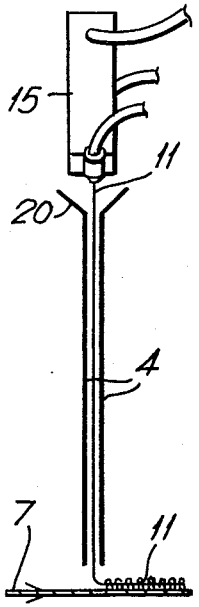
FIG. 3 is a side elevation of the apparatus of FIG. 2.

In the modified machine according to the invention a weft thread is supplied by an apparatus as illustrated in detail in FIGS. 2 and 3.

Referring in particular to FIGS. 2 and 3 a thread 11 is led by way of a tension roll 13 into the entry 14 of a forwarding jet 15 which is supplied with compressed air from a supply line 16 above the thread entry 14. The air tensions the thread and forwards it to the outlet 17 close to which on either side are positioned deflection jets 18 which are alternately supplied with pulses of compressed air by means of a motorised rotary valve 19. The thread 11 falls from the jet outlet 17 into the convergent entry 20 between two plates 4 narrowly spaced apart and arranged transversely and close to a moving layer of warp threads 7. (In the drawings the two plates are shown for clarity, as being parallel. However in practice, and as brought out in the accompanying Example, the plates are not parallel but are arranged so that they converge from the upper end to the lower end). Air jets 18 are directed alternately against the emerging thread 11 moving it first to the left and then to the right and causing it to oscillate and to assume a planar sinuous path as it falls between the plates 4. As the thread 11 passes between the plates 4 the initial motion imparted by the deflection jets 18 develops to its full extent until, when it reaches the needles 1 it has moved out to the full desired width and is laid down on the needles in successive parallel picks across the needles. To assist the thread 11 to enter the needles (not shown in FIGS. 2 and 3) in a uniform manner an air stream, acting essentially parallel to the plates, was provided by compressed air emanating from appropriately located perforations in a perforated tube 8 (see FIG. 1).

In FIG. 2 left and right moving lengths of thread 11 are shown moving in somewhat idealised fashion between plates 4 as broken lines. Examination of the apparatus illustrated in FIGS. 2 and 3, in operation, by means of a stroboscopic illumination through a transparent plate 4 shows that the thread takes up a uniform sinuous path, the form of which alters with changes in forwarding and oscillating speeds.

The plates 4 serve to control and stabilise the movement of the oscillating thread. The width of the plates 4 in the direction of oscillation should be at least equal to and is preferably just a little wider than the maximum width of the stitch bonded fabric to be produced.

The following Example also serves to illustrate the invention and the manner in which it may be performed.

EXAMPLE

A Malimo stitch bonding machine was modified as in FIG. 1 and was used to produce fabric of good and uniform quality, with the weft in essentially parallel picks and a cross laying angle of essentially 0°. The Malimo machine was provided with the usual stitching equipment to produce 14 gauge fabric at 1.67 m width (14 warp threadlines per 250 mm). 1100 decitex 192 filament polyester yarn constituted the layer of warp threads and 150 decitex 30 filament yarn constituted the stitching threads. Various types of yarn were used as the weft thread as detailed below, and optionally, a fibrous web was also fed into the needles through the space between the knock over table 5 and the plates 4 (FIG. 1). The weft thread was laid by the apparatus illustrated in FIGS. 2 and 3.

The weft yarn was taken from a package and forwarded to a forwarding jet supplied with compressed air. A motorised rotary valve was supplied with compressed air and gave alternate pulses of air to each of two deflector jets fitted immediately below the forwarding jet. Each deflector jet received compressed air from the rotary valve for approximately 50% of the valve rotation. The rotation speed of the rotary valve was precisely synchronised at 50% of the machine stitching speed. Adjustment was provided so that the position in the cycle of rotation of the rotary valve, relative to the stitching sequence, could be altered. The precise relative timing of the reversal of yarn lay and the stitching sequence was found to be of great importance in determining the uniformity of the weft lay in the fabric, especially at high stitching speeds and short stitch lengths. Incorrect setting of the rotary valve timing was found to result in alternating double and the absence of weft threads in the stitched fabric. The effect was most noticeable at the fabric edges.

The guide plates 4 were 1.8 meters wide by 400 mm high and spaced apart 6 mm at the top and 3 mm at the bottom. The plates were arranged in such a manner that a median line between the plates was inclined at an angle of 14° to the vertical so that the weft yarn was directed at the needle bed of the Malimo machine. An air stream, essentially parallel to the plates, was used to assist the weft yarn to enter the needles in a uniform manner. This air stream was produced by supplying compressed air to a 10 mm diameter tube of 2 meters in length in which 0.5 mm diameter circular perforations were drilled in a straight line at 20 mm intervals. The tube was mounted approximately 40 mm from the lower edge of the guide plates.

The weft yarn speed was adjusted so that the lay of yarn just exceeded the width of the needle bed, a typical weft lay width being 1.75 m.

The table below gives details of three types of fabric produced in this way:

| FABRIC TYPE | WEFT YARN TYPE/DECITEX/ FILAMENTS | TYPE OF FIBROUS WEB FED TO THE NEEDLES | STITCH LENGTH MM | STITCH FREQ-UENCY NO/ MIN | APPROX WEFT YARN SPEED M/MIN |
|---|---|---|---|---|---|
| 1 | Polyester/1100/192 | None | 1.32 | 820 | 1450 |
| 2 | Polyester/1100/192 | Polyester 50g/m$^2$ | 1.92 | 600 | 1050 |
| 3 | Polyester/150/30 | None | 1.32 | 1000 | 1900 |

I claim:

1. A machine for producing stitch bonded fabrics comprising means for supplying a layer of warp threads, means for continuously supplying a weft thread, means for supplying a plurality of stitching threads and means for stitching the warp layer and weft thread together with said stitching threads, the improvement being that the means for supplying and laying the weft threads consists of a pair of closely spaced plates, means for forwarding an individual thread towards the plates and means for imparting an oscillatory motion to the forwarded thread before it passes between the plates.

2. A machine as claimed in claim 1 in which the means for forwarding the individual weft thread is a compressed gas jet.

3. A machine as claimed in claim 1 in which the means for imparting an oscillatory motion to the forwarded thread consists of two gas jets.

4. A machine as claimed in claim 1 in which the plates are uniformily spaced apart throughout their height.

5. A machine as claimed in claim 1 in which the plates are inclined to each other so that the space between them converges from the upper ends of the plates to the lower ends of the plates.

6. A machine as claimed in claim 4 in which the plates are between 1 mm to 10 mm apart.

7. A machine as claimed in claim 5 in which the plates, at their upper end, are between 10 mm and 25 mm apart and, at their lower end, are between 2 mm and 5 mm apart.

8. A method of producing a stitch bonded fabric comprising forming a layer of warp threads, continuously providing a weft thread, stitching the warp layer and weft thread together by a stitching means with a stitching thread, the improvement being that the weft thread is introduced to the stitching means by passing an individual thread between two closely spaced plates and imparting an oscillatory motion to the thread before it is passed between the plates.

* * * * *